US005123210A

United States Patent [19]

Schmidt

[11] Patent Number: 5,123,210

[45] Date of Patent: Jun. 23, 1992

[54] FLIGHT OF STAIRS

[76] Inventor: Michael Schmidt, Grillparzerstr. 5, D-8000 München 80, Fed. Rep. of Germany

[21] Appl. No.: 613,477

[22] PCT Filed: Feb. 26, 1990

[86] PCT No.: PCT/EP90/00321

§ 371 Date: Oct. 26, 1990

§ 102(e) Date: Oct. 26, 1990

[87] PCT Pub. No.: WO90/10129

PCT Pub. Date: Sep. 7, 1990

[30] Foreign Application Priority Data

Feb. 26, 1989 [DE] Fed. Rep. of Germany ..... 3916590
Feb. 27, 1989 [DE] Fed. Rep. of Germany ... 8902301[U]

[51] Int. Cl.[5] ..... E04F 11/00

[52] U.S. Cl. ..... 52/182; 52/183; 182/228

[58] Field of Search ..... 52/182, 183, 187, 191, 52/188, 184; 182/93, 194, 228

[56] References Cited

U.S. PATENT DOCUMENTS

| | | | |
|---|---|---|---|
| 1,304,533 | 5/1919 | Bois | 52/191 |
| 3,909,997 | 10/1975 | Eikhof | 52/191 |
| 4,018,300 | 4/1977 | Geay | 52/182 |
| 4,367,613 | 1/1983 | Strub | 52/191 |
| 4,464,870 | 8/1984 | Crepeau | 52/191 |

FOREIGN PATENT DOCUMENTS

| | | | |
|---|---|---|---|
| 2231572 | 1/1974 | Fed. Rep. of Germany . | |
| 2460750 | 7/1976 | Fed. Rep. of Germany | 52/182 |
| 3728101 | 9/1988 | Fed. Rep. of Germany . | |
| 1592753 | 6/1970 | France . | |
| 2028847 | 10/1970 | France . | |
| 2057470 | 4/1971 | France | 52/182 |
| 2572443 | 5/1986 | France . | |
| 373546 | 1/1964 | Switzerland | 52/182 |
| 2114182 | 8/1983 | United Kingdom . | |

*Primary Examiner*—David A. Scherbel
*Assistant Examiner*—Kien Nguyen
*Attorney, Agent, or Firm*—Anthony J. Casella; Gerald E. Hespos

[57] ABSTRACT

The invention concerns a flight of stairs with a multiple of steps—where each step is firmly connected at least at one lateral end with the subsequent step by two vertical members, and where the bottom and top steps (22, 12) are resting on an intermediate floor (26, 24), a landing beam or a similar member, and where at least one lateral end of each step (12 to 22) is arranged within a square support—consisting of two horizontal and two vertical members (40, 42; 44, 46) which, together, form a stair stringer—in such a manner that each step is supported by its assigned horizontal member beneath it, and that each horizontal member (40, 42) is extended beyond a vertical member (44, 46), so that the extension (32) of the upper horizontal member (40) forms the lower horizontal member of the next step (12) above, while the extension (48) of the lower horizontal member (42) forms the upper horizontal member of the next step (16) beneath it, and where—at least on one side—a vertical member can be replaced by a spacer (206, 208, 306) or by the actual step (124, 128, 130) which, in this instance, must—at least on that side—be of the same thickness as a step height.

14 Claims, 5 Drawing Sheets

FLIGHT OF STAIRS

Figure 1:
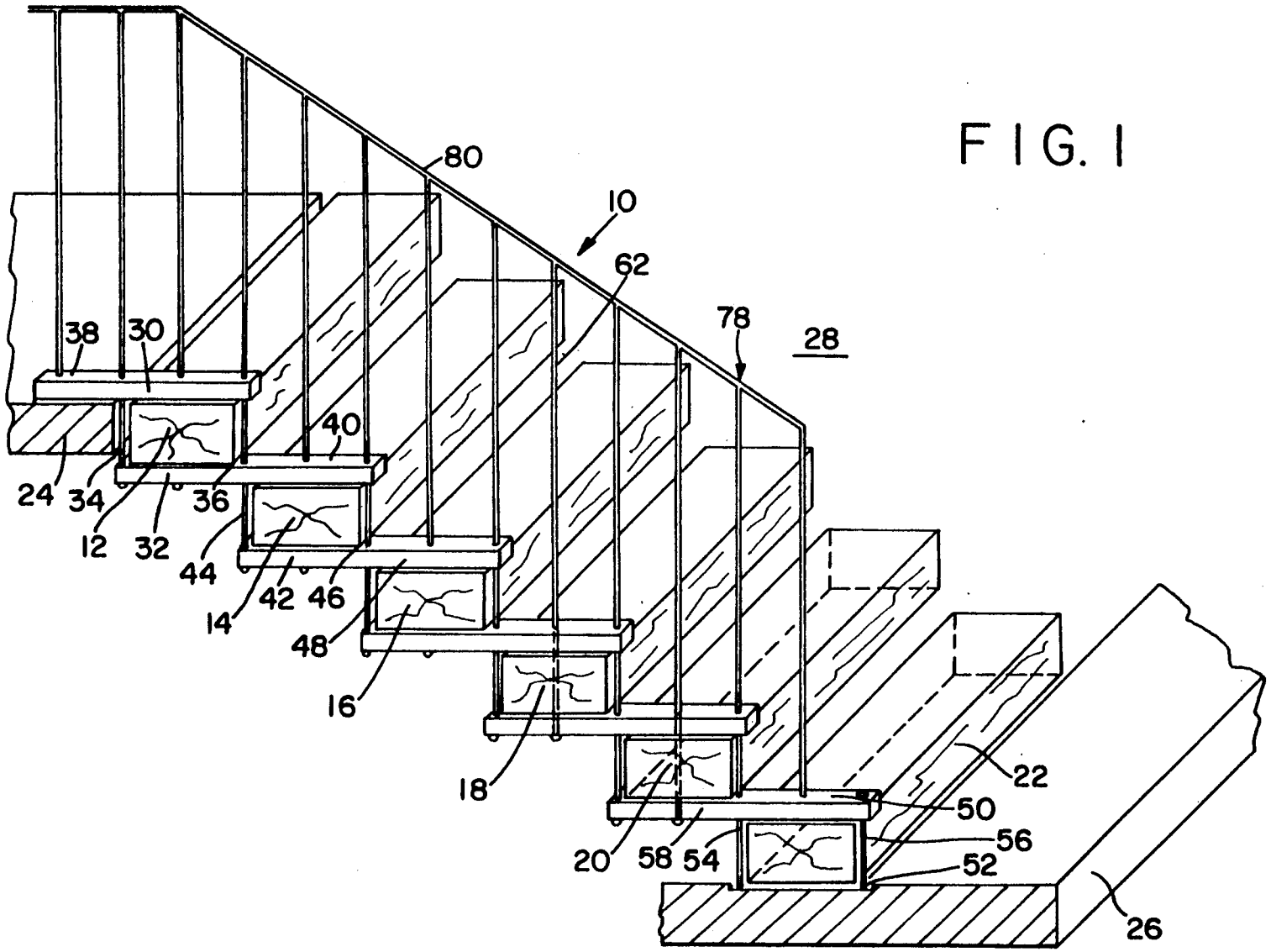

The invention concerns a flight of stairs with a multitude of steps, where each step is firmly connected at least at one lateral end to the next step by two vertical members, and where the bottom and top steps (22, 12) are resting on an intermediate floor (26, 24), landing beam or similar member.

Stairs are known in many different constructional variations. A flight of stairs in one piece can be produced in situ from concrete. The individual steps are then lined with treads and risers in the desired material. Another known method is to connect intermediate floors by prefabricated beams which, when placed alongside each other, form a flight of stairs. Furthermore, a design is known by which one end of the steps of a spiral staircase are anchored in a wall, while the other step ends are arranged in such a manner that these ends support each other. Such staircases are relatively expensive to produce, and any special requirements and deviations from standards can only be executed at a relatively high cost.

DE-OS 19 63 909 describes a spiral staircase with a projecting first step, and a multitude of steps where each step is firmly connected at one lateral end with the subsequent step by two parallel vertical members; the forces that have to be transmitted in horizontal direction are transmitted directly by the horizontal member acting as a step. DE-Gbm 1943606 shows a cuboid compression component between two steps where compression bodies and steps are held together by a vertical anchor. Here, too, the forces that are to be transmitted in horizontal direction are transmitted directly within the step.

The objective of this invention is to create a flight of stairs that can be produced by simple means, and that can be easily adapted to special conditions.

In keeping with the invention, this objective is achieved by the fact that at least one lateral end of each step is arranged within a square support—consisting of two horizontal and two vertical members which, together, form a stair stringer—in such a manner that each step is supported by the assigned horizontal member beneath it, and that each horizontal member is extended beyond a vertical member, so that the extension of the upper horizontal member forms the lower horizontal member of the next step above it, while the extension of the lower horizontal member forms the upper horizontal member of the next step beneath it, and where—at least on one side—a vertical member can be replaced by a spacer or by the actual step which, in this instance, must—at least on that side—be of the same thickness as a step height.

With elements produced in conformity with this invention it is possible to assemble the elements in situ to produce a flight of stairs that can then be arranged at the envisaged point between two intermediate floors. Adaptation to the prevailing peculiarities—for instance curves, offset arrangements or other designs—is possible by appropriate selection of the horizontal member lengths.

The arrangement of square supports at both step ends are to be preferred. In this event the steps will have no connection whatsoever with a wall of the building.

According to another preferred version, at least one end of the steps is anchored in the wall, thus creating a partially self-supporting flight of stairs. In this instance it is possible to anchor the end of each step in a wall, while the opposite is free. Alternatively, depending upon the local conditions, only some of the steps need be anchored in the wall, while the other steps are connected with each other at both ends by square supports.

According to another preferred version, the front vertical members of each square support are formed by vertical handrail standards. In this manner a combination of handrail and holders for the steps is achieved, thereby diminishing the necessary work to arrange the steps and fasten the handrail. If, for instance, the steps are staggered by half a step width in horizontal direction to each other, then all vertical members can be formed by vertical handrail standards, where the handrail standards proceed through the steps to form a front vertical member on one step, while underneath it forms a rear vertical member on the next step (FIG. 2), or on the next but one step (FIG. 1).

In further development of the invention, at least one of the vertical handrail standards can be designed as a tie rod and secured to a ceiling, a landing beam or a similar member. This is particularly advantageous with a very long flight of stairs where such a tie rod can be used as a staircase suspension between its two end supporting points.

The steps can be offset horizontally in relation to each other by one half of a step depth or less. If the step is offset by more than a step width in horizontal direction, then the front vertical member of one step aligns with the rear vertical member of the next step beneath it. The elements of such a version can be simplified.

The elements of each square support are preferentially made of metal, plastic, wood, concrete or composite materials which can be in rod or tubular form, or where their cross-section can be rectangular, round, oval, flat or the like.

According to the preferred execution forms the steps can be provided with stair treads and/or risers.

Examples of different versions of the invention are shown in the following drawings:

FIG. 1 The first version of a flight of stairs shown in a perspective view.

Figure 2:
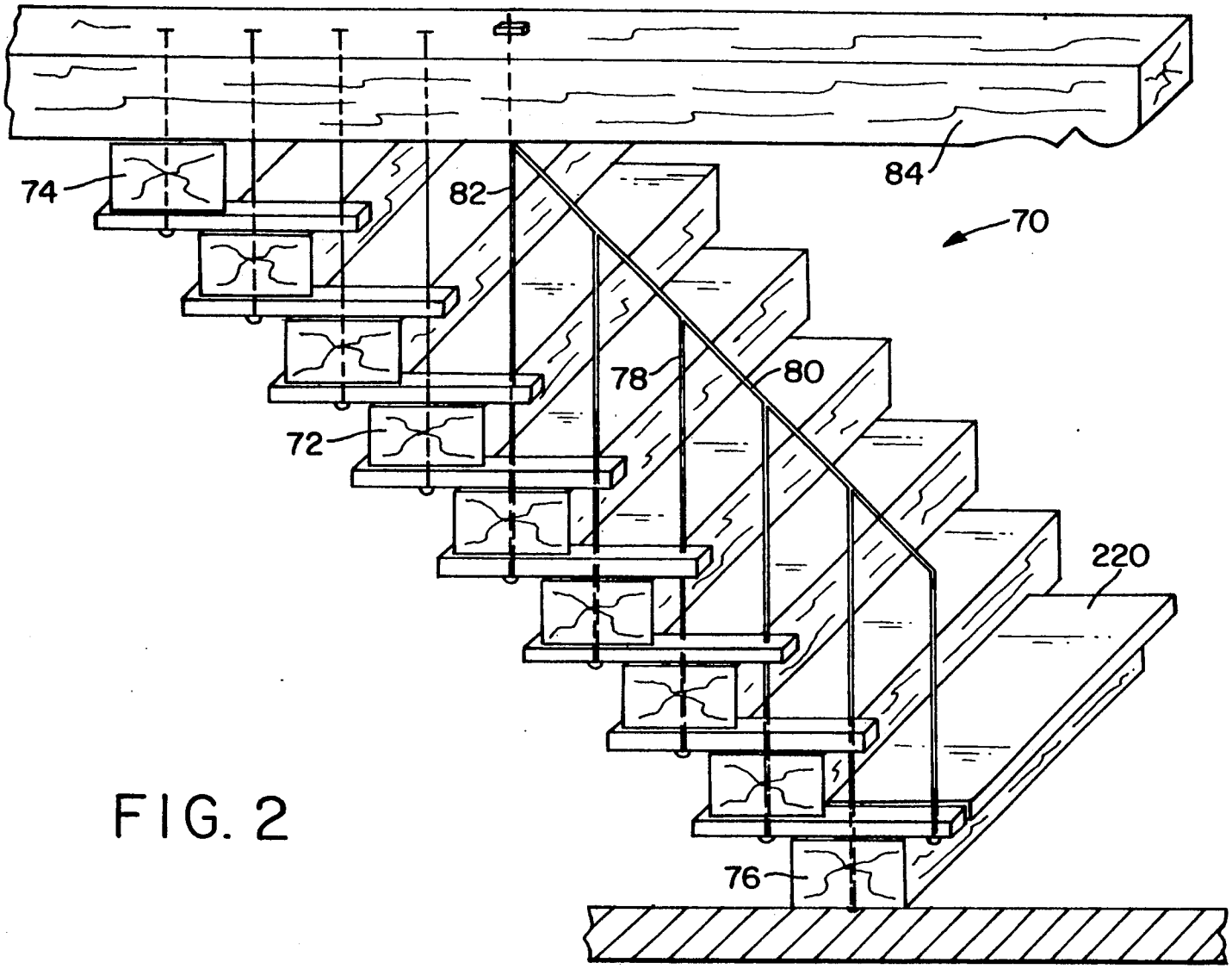

FIG. 2 A modified version of a flight of stairs shown in a perspective view.

Figure 3:
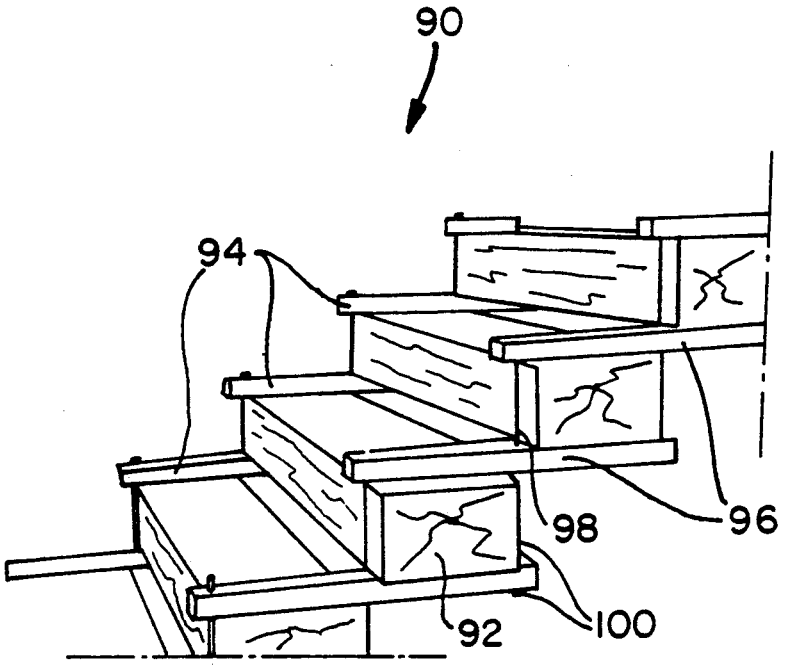

FIG. 3 A flight of stairs with stringers on both ends of the steps shown in a perspective view.

Figure 4:
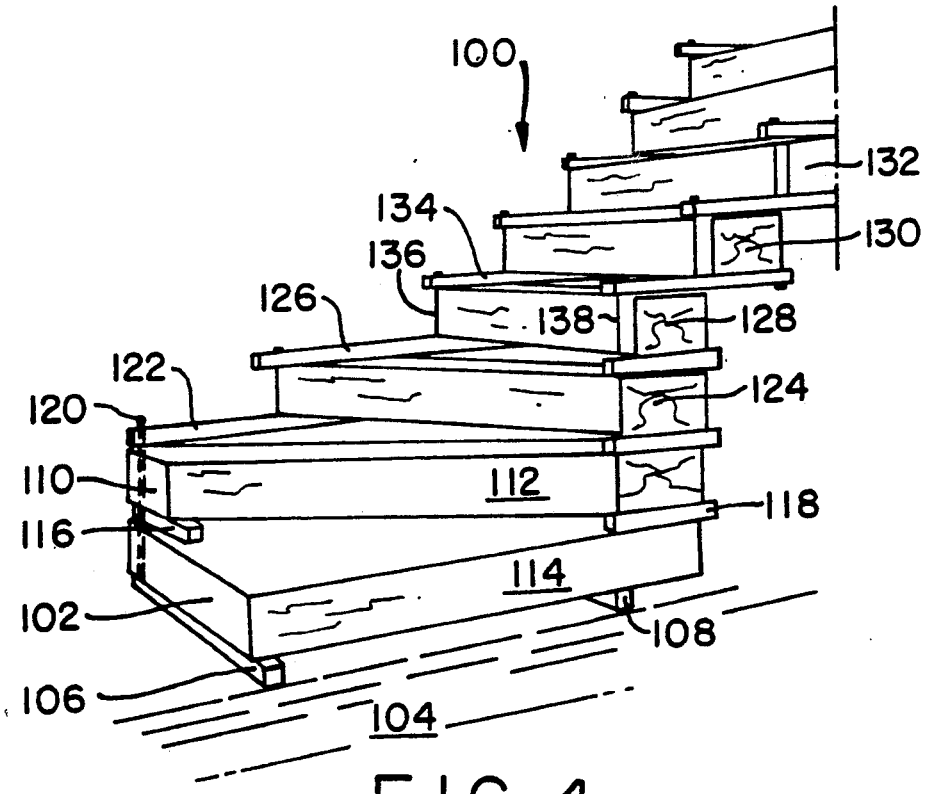

FIG. 4 A partial spiral staircase shown in a perspective view.

Figure 5:
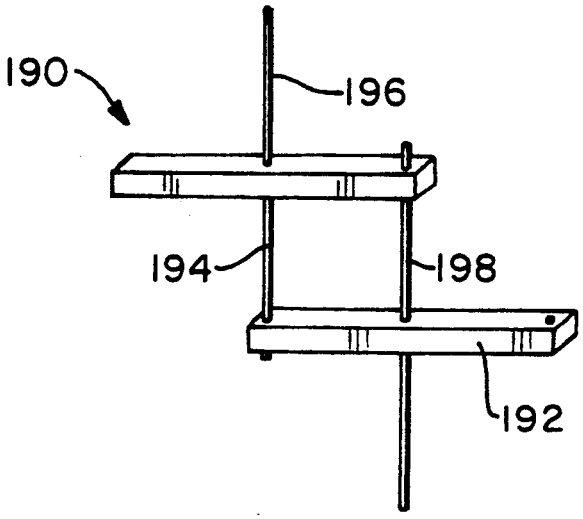
Figure 6:
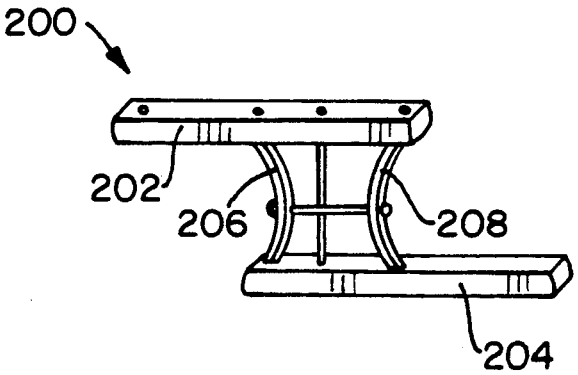
Figure 7:
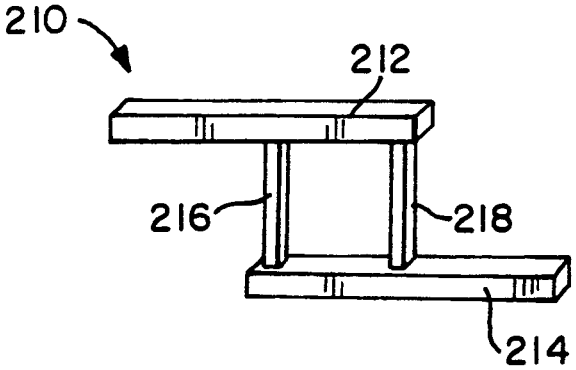

FIGS. 5–7 Different versions of square supports, with a curved vertical support shown in FIG. 6, and a covered screw connection in FIG. 7.

Figure 8A:
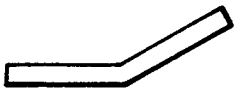
Figure 8B:
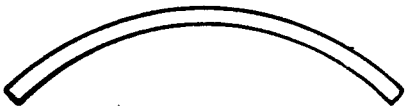

FIGS. 8A–8B Shows how the horizontal member is bent around its vertical axis, or angled, to match the course of the wall, for instance with a spiral staircase.

Figure 9:
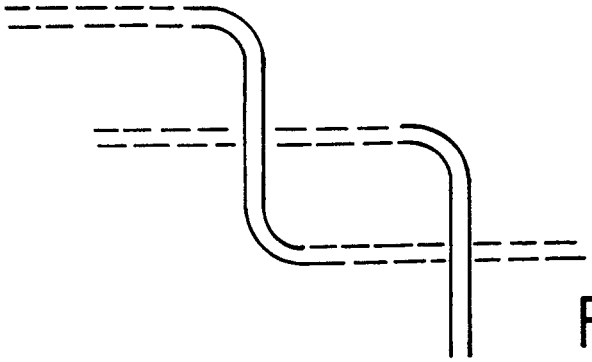

FIG. 9 It shows how the horizontal member is bent around a horizontal axis by approx. 90° where, after bending, the same member forms a vertical member above or below (or, depending upon how the vertical member is bent, it forms—after the bend—the horizontal member above or below).

Figure 10:
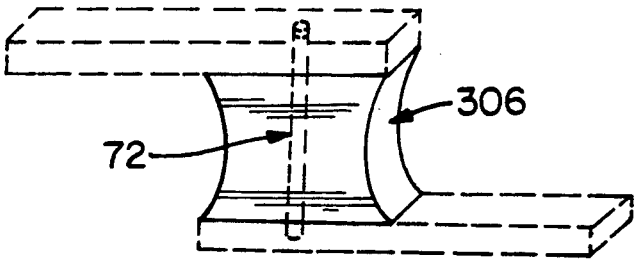

FIG. 10 It shows how the vertical member has been replaced by a spacer, as previously indicated in FIG. 6.

Figure 11:
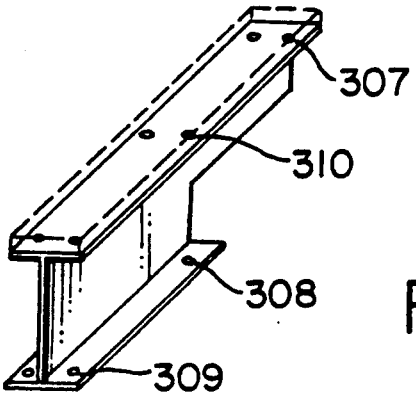

FIG. 11 It shows an I-girder where the web forms the square support, and the flange the horizontal member.

FIG. 1 shows a flight of stairs 10 consisting of the steps 12, 14, 16, 18, 20 and 22. Step 12 is the top one, and it is supported by the intermediate floor 24. Step 22 forms the bottom step, and it rests on the floor 26. One end of each of the steps 12 to 22 is anchored in the wall 28, whereas the opposite free end of each step is arranged in a square support. The square support of step 12 consists of an upper horizontal member 30, and a lower horizontal member 32, a rear vertical member 34, and a front vertical member 36. The horizontal members 30 and 32 are rigidly connected by screws with the vertical members 34 and 36, or by alternative means of fastening.

The top horizontal member 30 protrudes as an extension 38 beyond the rear vertical member 34. This extension 38 rests on the intermediate floor 24. The lower horizontal member 32 protrudes as an extension 40 beyond the front vertical member 36. This extension 40 simultaneously forms the upper horizontal member of the step 14 that follows step 12. The extension 40, together with a lower horizontal member 42, a rear vertical member 44 and a front vertical member 46, form a square support for step 14. The lower horizontal member 42 once again goes beyond the front vertical member 46 into the extension 48 which, in turn, forms the upper horizontal member of a square support for step 16. From this it can be seen that the member 32, together with the extension 40, form part of the square support for step 12, as well as part of the square support for step 14. This alternation of lower horizontal member with upper horizontal member for the next step beneath it, is continued in this manner up to step 22. At the lower step 22 there is a square support consisting of an upper horizontal member 50, a lower horizontal member 52, a rear vertical member 54, and a front vertical member 56. Step 22, and thus the entire flight of stairs, rests with its lower horizontal member 52 on the floor 26. The upper horizontal member 50 forms the extension of the lower horizontal member 58 of the step 20 above it.

FIG. 1 shows how the vertical handrail standards 62 pass through the horizontal members of the square supports of the steps 20 and 16. This guarantees secure fastening, and the stability of the square supports of the steps 20 and 16 is simultaneously improved.

FIG. 2 shows a flight of stairs 70 with a multitude of steps 72, and with a top step 74 and a bottom step 76. At the end of each step 72, 74 and 76 there is a square support consisting of horizontal members and vertical members, while the opposite end of the steps are anchored in the wall.

With the manner of execution shown in FIG. 1, the steps 12 to 22 are staggered in relation to each other by approximately a full step depth. In this manner the front vertical member of one step is aligned with the rear vertical member of the step beneath it. As opposed to this arrangement, according to the manner of execution shown in FIG. 2, the steps are offset by approximately half a step depth. In this manner the front vertical member is approximately over the rear vertical member of the step that is the next but one to the first step. Furthermore, contrary to the version in FIG. 1, the vertical handrail standards 78 form the front vertical members of each square support. The vertical members 78, together with the handrail 80, form the staircase railing. A vertical member 82 of the handrail is attached to the intermediate floor 84 to which the top step 74 is attached. In this manner the vertical member 82 simultaneously functions as a tie rod for the flight of stairs 70. Consequently, in addition to the connection of step 74 and the support provided by step 76, the suspension prevents vibrations when a flight of stairs of this relatively long length is walked upon.

FIG. 3 shows a flight of stairs 90 with the steps 92, fitted at both ends with square supports 94, 96. In this manner continuous stringers are formed on both sides of the flight of stairs. The steps are offset horizontally in relation to each other by somewhat more than the step depth. In this manner, the front vertical member 98 of a step is aligned with the rear vertical member 100 of the step beneath it.

FIG. 4 shows a flight of stairs 100 where the lower section is at a right angle to the top section. The bottom step 102 is supported on the floor 104, and rests on the members 106 and 108, and it consists of a multiple of step elements. Above it is step 110 with a front surface 112 that stands at an acute angle in relation to the front surface 114 of the step 102 beneath it. The horizontal members 116 and 118 are arranged between the steps 110 and 102. The vertical member 120 connects the horizontal member 116 with the long horizontal member 122 which simultaneously forms the lower horizontal member on one side of the step 124 above it.

The extension of the upper horizontal member 126 of step 124 forms the lower horizontal member of a step 128 which is in a straight line with the subsequent steps 130 and 132. The connection of the horizontal members 126 and 122, as well as with the upper horizontal member 134 of step 128, is by the vertical members 136 and 138, respectively. The other ends of the steps 110. 126, 128, 130 and 134 are connected with each other by square supports which are formed as the versions shown in FIGS. 1 to 3. FIG. 4 also shows that the ends of the steps 110, 124, 128, on the right-hand side of the drawing, are aligned above each other without being offset, while the steps 128, 130 and 132 are regularly offset in relation to each other.

The FIGS. 5 to 7 show individual types of square supports. The version in FIG. 5 shows a square support 194 formed by the horizontal members 190 and 192—composed of square pipes—and rod-shaped vertical members 196 and 198.

FIG. 6 shows a square support 200 that consists of the horizontal members 202 and 204 of rectangular cross-section that are interconnected by way of the forged vertical members 206 and 208. In the indicated form, the vertical members 206 and 208 could also be regarded as spacers.

The square support 210 shown in FIG. 7 is formed by the horizontal members 212 and 214, and by the vertical members 216 and 218, both of which are made of rods of rectangular or square cross-section, or of rectangular pipes. The screw connections of the vertical members are covered.

As opposed to the versions shown in FIGS. 3 and 4, where the steps consist of solid beams without risers and stair treads, the steps shown in FIGS. 1 and 2 have stair treads 220 and 222 (FIG. 2). It is also possible to provide the steps with risers in the desired material and decoration.

FIG. 8 shows a horizontal member that is curved or bent around a vertical axis to adapt it to the shape of a wall, for instance with spiral staircases.

FIG. 9 shows how the horizontal member is bent by approx. 90°; after the bend, the horizontal member forms the previous and the successive vertical member, or vice versa where, after the bend of the vertical member, the latter forms the horizontal member above or below it. The cross-over points can be connected by screws or welding. This results in a staircase of very elegant and stable design.

The spacer shown in FIG. 10 only requires one vertical member; a handrail standard can pass through it.

The I-girder type member shown in FIG. 11 is ideally suited for temporarily required stairways, for instance on building sites, because they can be easily erected and dismantled. Grating is ideal for steps on building sites because they provide a completely non-slip surface.

Naturally, the lower flange can be extended forwards by another step width underneath to directly form the horizontal member beneath it. Alternatively, another I-girder, identical to the one shown in FIG. 11, can be placed underneath it. The screw holes 307 of the underneath section are connected with the screw holes 308 of the above section (just as the front holes 309 of the above member section are connected with the screw holes 310 of the member section beneath it).

I claim:

1. A flight of stairs comprising a plurality of steps, each said step including opposed lateral ends, a top surface, a bottom surface, a front face and a rear face, each said step including a generally square support at at least one lateral end thereof, each said square support comprising a top horizontal member on the top surface of each said step, a bottom horizontal member on the bottom surface of said step and a plurality of vertical members connecting the respective top and bottom members, said vertical members including at least a front vertical member and a rear vertical member, each said bottom horizontal member being a unitary extension of the top horizontal member of the next lower step in the flight of stairs.

2. A flight of stairs in keeping with claim 1, wherein the square supports are arranged on both of the lateral ends of each said step.

3. A flight of stairs in keeping with claim 1, for use in proximity to a substantially vertical wall, at least some of the steps are anchored in the wall at one lateral end thereof.

4. A flight of stairs in keeping with claim 1, wherein the vertical members of each said square support are arranged parallel to each other.

5. A flight of stairs in keeping with claim 1, further comprising a handrail, the front vertical members of the square supports define vertical handrail standards which then form the rear vertical member of the step beneath it.

6. A flight of stairs in keeping with claim 5, wherein at least one of the vertical handrail standards is formed as a tie rod that is anchored to an intermediate floor.

7. A flight of stairs in keeping with claim 1, wherein the steps are further provided with stair treads on the respective top surfaces thereof.

8. A flight of stairs in keeping with claim 1, wherein the horizontal members are bent around a vertical axis.

9. A flight of stairs in keeping with claim 7, wherein the horizontal members are bent around the horizontal axis by practically 90° so that they then form the vertical member of the subsequent step.

10. A flight of stairs in keeping with claim 1 wherein the square support is formed by a girder web, and the horizontal members by a girder profile, of an I-girder.

11. A flight of stairs as in claim 1 wherein each said front vertical member disposed in front of the front face of each said step, and wherein each said rear vertical member is disposed behind the rear face of each said step, the front vertical member in at least one step of said flight of stairs defining a unitary extension of the rear vertical member for the next lower step in the flight of stairs.

12. A flight of stairs as in claim 1 wherein at least one vertical member of each said generally square support passes through the associated step.

13. A flight of stairs comprising a plurality of steps, each said step including opposed lateral ends, a top surface, a bottom surface, a front face and a rear face, said plurality of steps including a top step and a plurality of lower steps, such that each said lower step has a next higher step substantially adjacent thereto, said flight of stairs including generally square supports for at least each of said lower steps, said square supports being disposed at at least one lateral end of each said step, said square supports comprising: a top horizontal member on the top surface of each said lower step projecting beyond the rear face of the respective lower step and in abutting relationship to the bottom surface of the next higher step, and a plurality of vertical members extending between and connecting the horizontal member of each said lower step and the horizontal member of the next higher step.

14. A flight of stairs as in claim 13 wherein the top step further includes a horizontal member, two of said vertical members passing through the horizontal member of the top step and connecting to the horizontal member of the lower step to the top step.

* * * * *